US006321723B1

(12) United States Patent
Merkle et al.

(10) Patent No.: US 6,321,723 B1
(45) Date of Patent: Nov. 27, 2001

(54) METHOD OF RETARDING INJECTION TIMING

(75) Inventors: Albert J. Merkle, Westlake; Rodney Bormann, Cleveland Heights, both of OH (US)

(73) Assignee: Alfred J. Buescher, Shaker Heights, OH (US)

( * ) Notice: Subject to any disclaimer, the term of this patent is extended or adjusted under 35 U.S.C. 154(b) by 0 days.

(21) Appl. No.: 09/633,325

(22) Filed: Aug. 7, 2000

(51) Int. Cl.[7] ..... F02M 37/04
(52) U.S. Cl. ..... 123/500; 123/508
(58) Field of Search ..... 123/495, 496, 123/500, 501, 503, 504, 508; 239/88, 89, 90, 91, 92

(56) References Cited

U.S. PATENT DOCUMENTS 2,144,862 * 1/1939 Truxell, Jr. ..... 239/88
2,569,233 * 9/1951 Dickson et al. ..... 123/502
2,576,451 * 11/1951 Dickson et al. ..... 417/498
2,591,401 * 4/1952 Camner ..... 239/533.7
2,898,051 * 8/1959 Teichert ..... 239/533.5
4,565,320 * 1/1986 Taniguchi et al. ..... 239/90
4,648,556 * 3/1987 Leblanc et al. ..... 239/88
5,328,094 * 7/1994 Goetzke et al. ..... 239/88
5,611,317 * 3/1997 Peters et al. ..... 123/501

* cited by examiner

*Primary Examiner*—Willis R. Wolfe
*Assistant Examiner*—Hai Huynh
(74) *Attorney, Agent, or Firm*—Pearne & Gordon LLP

(57) ABSTRACT

A method of retarding injection timing of EMD-type unit injectors by a desired amount of crank degrees includes the steps of providing a modified pump plunger whose control helices differ, in their spacing from the top face of the associated tappet, from the spacing of the control helices of the pump plunger of the original injector from the top face of the associated tappet, such difference in spacing being by an amount equal to the amount of retardation, in linear units, that corresponds to the desired amount of retardation in crank degrees, and assembling the modified pump plunger into an injector assembly.

4 Claims, 2 Drawing Sheets

METHOD OF RETARDING INJECTION TIMING

This invention relates to an improved method for retarding injection timing of EMD-type unit injectors in diesel engines, including those in service in the field, as for example in fleets of diesel locomotives in railroad service, or in other diesel engine applications.

BACKGROUND OF THE INVENTION

EMD-type unit injectors are injectors of a type manufactured or formerly manufactured by EMD. They feature mechanical control of timing, as distinguished from electronic (solenoid) control, and are well known to those familiar with the art to which the invention relates. EMD-type injectors are widely used to power railroad engine locomotives, and continue to compete successfully with electronically-controlled designs.

One aspect of these systems is injection timing. The current method for adjusting injection timing on EMD engines is to set the injector's port-closing position with reference to the engine cam position. With roots-blown engines this is done when the cylinder piston is two degrees before top dead center. For turbo-charged engines this is done when the cylinder piston is in its top dead center position. In both instances, the associated engine cam follower is still in following contact with the base circle of the associated engine cam, that is, there is maximum spring-driven retraction of the drive linkage that powers the injector pump plunger, but this retraction may vary somewhat from a desired norm due to variations in conditions encountered when installing or reinstalling the injector, or due to wear of elements of the drive linkage during use, thereby causing improper timing.

The drive linkage that powers the injector pump includes a rocker arm assembly that actuates the injector plunger as determined by the engine cam profile. Adjustment of injection timing is done by turning an adjusting screw on the output end of the engine rocker arm. The drive linkage that powers the plunger includes (a) the associated engine cam, (b) a rocker arm assembly, including a rocker arm proper, a cam follower at the input end of the arm and the said adjusting screw at the output end, (c) a "button" or socket pad on the head of the adjusting screw and forming, together with the head, a ball-and-socket joint, and (d) a spring-loaded tappet or follower carried by the injector body and slidably engaged by the pad in a manner to accommodate the slight variance between the rocking motion of the adjusting screw and pad and the strictly rectilinear motion of the tappet. The tappet and plunger are in end-to-end engagement and are linked together for movement together in both directions.

Turning the adjusting screw changes the free length of the adjusting screw below the output end of the rocker arm proper, and has the effect of shortening or lengthening the drive linkage, which may need adjustment upon installation of the injector, or may have experienced significant wear during service. The linkage length is changed in this manner until there is a certain specified timing distance between the top face of the tappet and a fixed surface, namely the top flat face of the injector body. Such specified timing distance is the distance that obtains when the cut-off helix of the plunger is at some predetermined remove above the point at which it will close off its associated spill port in the plunger bushing to thereby initiate injection. When this specified timing distance obtains, the drive linkage is in properly adjusted position, and the adjusting screw is at what may be referred to as its set point. Such specified timing distance is usually listed on the engine manufacturer's data plate. Setting gages are provided so that the specified timing distance may be more readily confirmed, and more readily adjusted to if not initially confirmed. Once the adjusting screw is confirmed to be at its set point, it is fixed there by tightening an associated lock nut.

All this is well known to industry mechanics, who often carry in memory such specified timing distance for a particular engine model or models, or perhaps different specified timing distances for different engine models.

There is continuing pressure from regulatory agencies and public opinion to reduce nitrous oxide emissions from locomotive engines and other diesel engines. As a result, the railroad, diesel engine, and fuel injection equipment industries are continually reviewing the design and performance characteristics of the various components of the several interrelating systems that contribute to engine emissions and other performance characteristics.

Injection timing is an important component of these systems. Changes in timing have significant effects on fuel economy, engine noise, and emissions. Retarding injection timing is presently one of the readily available methods, combined with one or more others, to reduce nitrous oxide emissions. A usual method of retarding injection is by simply changing or re-specifying the specified timing distance, and then rotating the timing screw until the new specified timing distance obtains.

However, adjustment of injection timing from its originally intended setting by rotation of the adjusting screw has several disadvantages. Doing so amounts to establishing a new screw set point, and correspondingly, a new specification for the desired distance from the top of the follower to the top face of the injector body, inconsistent with the timing distance specified on the engine data plate. A new setting gage and new engine marking must be provided.

Moreover, the new timing distance specification or adjusting screw set point prescribed to retard injection timing and thereby meet emission requirements may be different for different engine models, even though the old timing distance specification or adjusting screw set point for those models was the same, compounding the opportunity for error by a mechanic in setting the correct new injector timing.

When changing injection timing or making any other modifications or adjustments in the equipment, a number of factors must be taken into consideration and balanced against each other. One factor is engine fuel efficiency. The effect on engine fuel efficiency of any change in injection timing is an important consideration. From a fuel efficiency standpoint, a method of retarding injection timing that is accompanied by better fuel efficiency than that resulting when the retarding method is simply rotating the adjusting screw to a new setting, corresponding to a new specified timing distance, is obviously to be preferred.

BRIEF DESCRIPTION OF THE INVENTION

According to the present invention, injection timing is retarded by a method which allows the set point of the adjusting screw to remain unchanged. At the same time, an engine whose fuel injection timing is retarded by the method of the invention exhibits better fuel efficiency than one whose fuel injection timing is retarded by simply rotating the adjusting screw to a new setting.

The method of the invention comprises replacing the pump plunger of the injector with a pump plunger which is preferably of the same length but whose helices, or at least the operative portions thereof, are spaced closer to the top face of the associated tappet than are the corresponding operative portions of the helices of the original pump plunger. The difference in spacing corresponds to the amount by which injection timing is retarded. The above referred to "specified timing distance" and the screw set point remain the same as when the original plunger was used. If the specified timing distance was listed on the engine data plate, that listing remains applicable. If setting gages have been made or provided, those same gages can continue to be used.

These and other advantages of the invention will be better understood from the detailed description of the invention given below.

BRIEF DESCRIPTION OF THE DRAWINGS

In the drawings, FIG. 1 also shows a broken-away associated section of the wall of the cylinder head of an EMD-type engine in which the injector is clamped by suitable holding clamps (not shown).

FIGS. 2A and 2B diagram elements as they appeared when the injection timing was at an original or unretarded setting. FIGS. 2C and 2D diagram a corresponding set of elements after the practice of the conventional method of retarding injection timing. FIGS. 2E and 2F diagram a corresponding set of elements after the practice of the method of the invention.

DETAILED DESCRIPTION OF THE INVENTION

Figure 1:
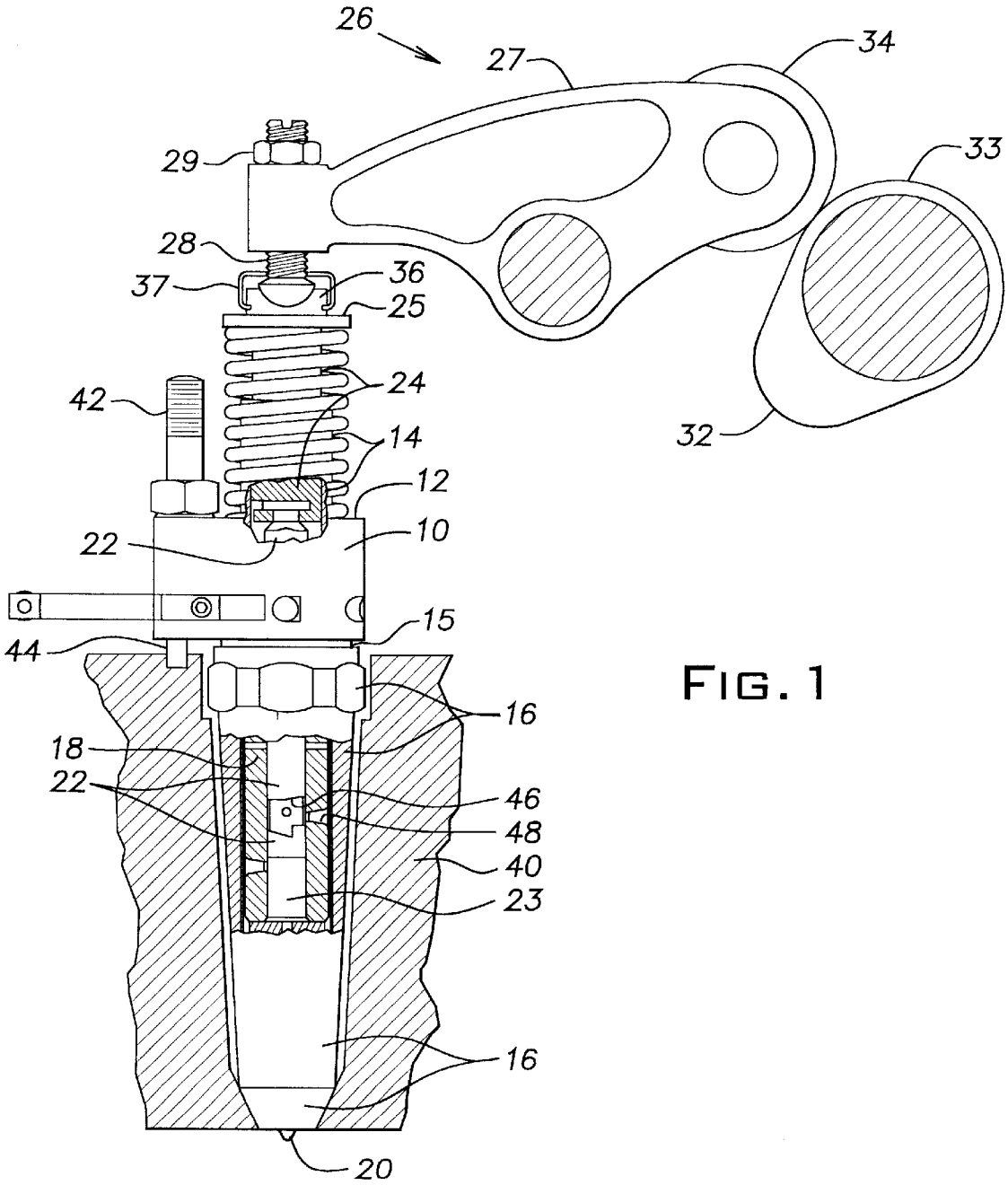
FIG. 1 is a partially broken-away elevation view of an EMD-type unit injector, together with the associated drive linkage that powers the injector's pump plunger.

The method of the invention is practiced with reference to an EMD-type unit injector and associated apparatus such as shown in FIG. 1. An EMD-type unit injector typically comprises an injector body 10 having a flat top face 12 above which an integrally-formed tappet-receiving upper boss 14 extends a short distance in the vertical direction. The injector body also has an integrally formed lower boss 15 on which a housing nut 16 is threadedly received and tightened down. Elements within the housing nut include the plunger bushing 18, an injection nozzle body (which is mostly not visible in FIG. 1, but from which an integrally formed nozzle tip 20 projects), and various spacers, valves and other elements (not visible in FIG. 1) clamped in stacked relation between the bottom of the plunger bushing 18 and the top of the nozzle body.

The injector is clamped in the wall 40 of the cylinder head of the associated engine by an injector hold-down crab or clamp (not shown) which engages the hold-down stud 42. The orientation of the injector in its clamped position is further defined by the locator pin 44.

A pump plunger 22 is slidably received within the plunger bushing 18. A spring-loaded tappet or follower 24 is slidably carried by the injector body 10 within the upper boss 14. As shown in FIG. 1, the plunger 22 and tappet 24 are in end-to-end engagement and are linked together by the illustrated flange-and-slot arrangement for movement together in both directions.

The drive linkage that powers the injector pump includes a rocker arm assembly 26 that actuates the injector plunger as determined by the engine cam profile. Adjustment of injection timing to the proper setting is done by turning an adjusting screw 28 on the output end of the rocker arm assembly. For this purpose, the upper end of the adjusting screw is provided with a hex socket (not shown) to receive a hex wrench, or is slotted, as indicated in FIG. 1, to receive a screwdriver. The adjusting screw is provided with a lock nut 29 to lock it in its adjusted or set position.

The drive linkage that powers the plunger includes (a) the associated engine cam 32 having a base circle 33, (b) the rocker arm assembly 26, including the rocker arm proper 27, the cam follower 34 at the input end of the arm, and the adjusting screw 28 at the output end, (c) a "button" or socket pad 36 on the illustrated head of the adjusting screw and forming, together with the head, a ball-and-socket joint, and (d) the spring-loaded tappet or follower 24 carried by the injector body (as previously described) and whose flat top face 25 is slidably engaged by the pad 36 in a manner to accommodate the slight variance between the rocking motion of the adjusting screw and pad and the strictly rectilinear motion of the tappet. As shown in the drawing, a spring clip or retainer 37 is provided to hold the button or socket pad 36 on the head of the adjusting screw.

The bottom face of the plunger and the lower portions of the walls of the plunger bushing 18 define a pump chamber 23 which is also bounded by the next element below the bottom of the plunger bushing.

Turning the adjusting screw 28 has the effect of shortening or lengthening the drive linkage, which may need adjustment upon installation of the injector, or may have experienced significant wear during service. The linkage length is changed in this manner until there is a certain specified timing distance t (see FIG. 2A) between the top flat face 25 of the tappet and a fixed surface, namely the top flat face 12 of the injector body. Such specified timing distance is the distance that obtains when the cut-off helix 48 of the plunger is at some certain remove p above the point at which it will close off its associated spill port 48 in the plunger bushing 18 to thereby initiate injection. When this specified timing distance obtains, the drive linkage is in properly adjusted position, and the adjusting screw is at what may be referred to as its set point.

Such specified timing distance is usually listed on the engine manufacturer's data plate. Setting gages are provided, such as the gage 48 shown in phantom in FIG. 2A, so that the specified timing distance may be more readily confirmed, and more readily adjusted to if not at first confirmed. Once the adjusting screw is confirmed to be at its set point, it is fixed there by tightening an associated lock nut 29.

Assume the injector shown in FIG. 1 is the original or reference injector originally installed in the engine block, and assume that its adjusting screw is adjusted to its set point, i.e. to the point where the timing distance is that specified on the engine data plate, namely t, so that the originally desired injection timing obtains. When the plunger is fully retracted, the parts will be positioned as seen diagrammatically in FIG. 2A. At the start of injection, the parts will be positioned as seen diagrammatically in FIG. 2*b*.

One way to retard injection timing by a given amount is to turn the adjusting screw so as to decrease its free length to a the point where a new specified timing distance t' is established (FIG. 2C), t' exceeding t by the amount of retardation r, expressed in linear units, that corresponds to the desired amount of retardation in crank degrees. However, the timing distance specified on the engine data plate will no longer apply; rather the new timing distance t', between the top face 25 of the tappet and the top face 12 of the injector housing, will have to be specified in order that future adjustments, when required by wear or other causes, may be made to the new set point. A new timing gage, conforming to the newly specified timing distance t', will also have to be provided. When the plunger is fully retracted, the parts will be positioned as seen diagrammatically in FIG. 2C. At the start of injection, the parts will be positioned as seen diagrammatically in FIG. 2D.

Figure 2:
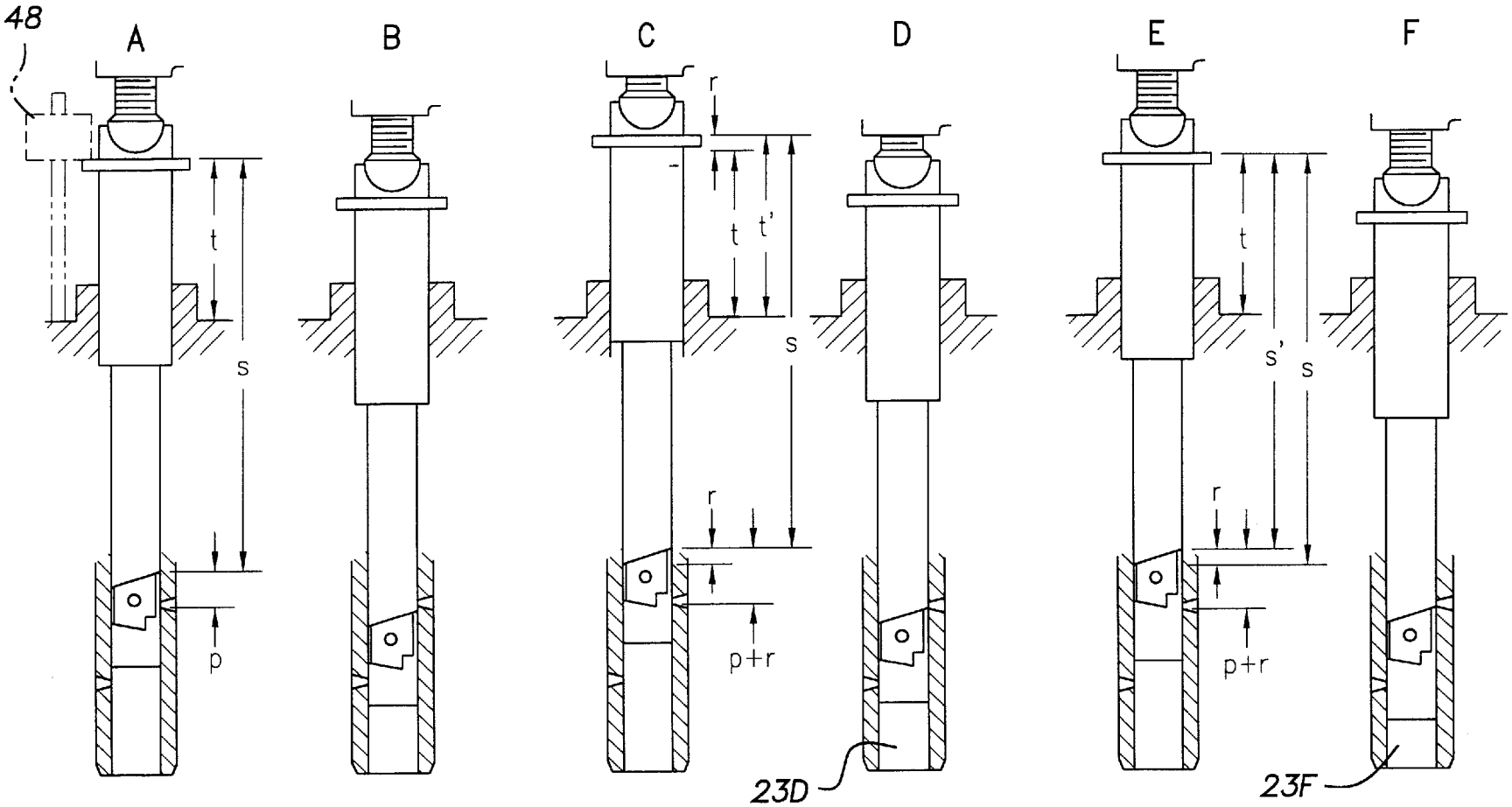
FIG. 2 is a set of comparative diagrams, each showing the same portion of the same injector body and the same portion of the same plunger bushing (both are fixed elements), and also showing certain moving elements when the plunger is at the top of its stroke (FIGS. 2A, 2C and 2E) or when the plunger is positioned at its start-of-injection positions (FIGS. 2B, 2D and 2F).

According to the invention, instead of retarding injection timing in the manner just described or some similar manner, timing is retarded from the timing of the reference injector by providing a modified injector containing a modified pump plunger having helices whose operative portions are of the same shape as the operative portions of the helices of the pump plunger of the reference injector, but whose spacing from the top face of the tappet when the plunger and tappet are assembled is smaller, as compared to the assembled pump plunger and tappet of the reference injector, by an amount equal to the aforesaid amount r, the amount of retardation in linear units that corresponds to the desired amount of retardation in crank degrees. For example, the highest point on the cut-off helix that is in the plane of cross-section in the drawings may be taken as a representative point. It is spaced distance s from the top face of the tappet in FIG. 2A, but the corresponding second representative point in FIG. 2E is spaced the distance s' from the top face of the tappet, the distance s' being smaller than the distance s by the aforesaid amount r. Since the operative portions of the helices of FIGS. 2A and 2E are of the same shape, the same spacing differential r applies to all points on such operative portions.

Note in particular that the same timing distance t nominally specified for the reference injector of FIGS. 2A and 2B continues to apply for the injector of FIGS. 2E and 2F, whose timing has been modified by the method of the invention. The nominal specified timing distance listed on the original engine data plate will remain correct. The gage once used for the reference injector will continue to be usable with the modified injector.

Preferably, the substitute plunger represents the only modification of the elements of the original injector, so that the desired retardation can be accomplished simply by substituting the modified pump plunger for the original one (and then confirming that the adjusting screw is at the same nominal set point as was called for when the reference injector was used, or adjusting it to that point if called for). This substitution may be accomplished as part of an injector rebuilding and replacement program, or a remanufacturing program, in which all elements save the plunger remain of identical design and can be refurbished or replaced or not, as called for by their condition. Or the substitution may be performed as part of any maintenance operation, or as part of a design revision in the manufacture of original equipment.

Preferably, as shown in FIGS. 2E and 2F, the length of the substitute plunger is the same as that of the plunger of the reference injector. Less preferably, based on current knowledge, the length of the substitute plunger may be slightly greater than that of the plunger of the reference injector, or may be slightly less.

With the length of the substitute plunger the same as that of the plunger of the reference injector, then at the start-of-injection cut-off point seen in FIG. 2F, the pump chamber 23F will be seen to be smaller than the pump chamber 23D is at the start-of-injection cut-off point seen in FIG. 2D. This reduced volume of the pump chamber at start-of-injection cut-off point is believed to be associated with the superior fuel efficiency that has been found to apply to injectors whose injection timing is retarded by the method of the invention. In one comparison, when the same retardation of six degrees of crank angle was accomplished by the common known method to which FIGS. 2C and 2D apply and by the method of the invention, the latter method resulted in a fuel economy 1 to 2 percent improved over that resulting from the common known method.

Even when the length of the pump plunger is slightly greater or less than that of the reference injector, the fuel economy advantage may persist to a degree because there will still be some degree of reduction in volume of the pump chamber at the start-of-injection cutoff point, as compared to the common known method of retarding injection timing. However, with excessive changes in the length of the pump plunger as compared with the reference injector, this degree of reduction of volume may become so small as to lose significance, or so great as to be counterproductive. In general, a change in length of no more than 0.5r is preferred, and no more than 0.25r is even more preferred. Most preferred, as indicated above, is no change in length of the pump plunger as compared to that of the reference plunger.

The invention is not to be limited to details of the above disclosure, which are given by way of example and not by way of limitation. Many refinements, changes and additions are possible, as should be evident to those familiar with the art.

What is claimed is:

1. A method of providing an injector to be used in a given model of EMD type engine and having its injection timing retarded by a given amount r, expressed in lineal units, as compared to a reference injector with unretarded timing and previously used in said given model, said given amount r, expressed in lineal units, corresponding to the desired amount of retardation expressed in crank degrees, said provided injector and said reference injector each being of a construction having a plunger-drive linkage including a tappet and also including an adjusting screw constituting an adjustable-length link for compensating for variations in conditions encountered upon injector installation, or for wear of the linkage, the free lengths of the screws of said provided injector and said reference injector each being capable of being set at a screw set point where the distance from the top face of the screw's associated tappet to the top face of the screw's associated injector body is set to a specified timing distance to accomplish said aforementioned compensation, said setting being done at a specified position of the associated engine cylinder piston in its cycle, said method comprising the steps of:

determining the distance-from-tappet-top spacing of a first representative point on the operative portions of the plunger helices of said reference injector from the top face of the tappet of said reference plunger when said plunger and tappet are assembled together, providing a modified plunger having helices whose operative portions are of the same shape as the operative portions of said plunger helices of said reference injector, and include a second representative point corresponding said aforesaid first representative point, said helices of said modified plunger being so located that said second representative point is spaced from the top face of its associated tappet, when said modified plunger and associated tappet are assembled together, by a distance-from-tappet-top spacing that is differs from and is smaller than the distance-from-tappet-top spacing of said first representative point, said difference being by said amount r, and assembling said modified plunger into an injector assembly constituting said provided injector whereby an injector is provided whose timing will be retarded by said given amount r when its screw is at a screw set point corresponding to the same nominal specified timing distance, from top face of tappet to top face of injector body, specified for the screw set point of said reference injector.

2. A method as in claim 1, said step of providing a modified plunger including the step of providing a plunger varying from the length of the plunger of said reference injector by no more than the amount 0.5r.

3. A method as in claim 1, said step of providing a modified plunger including the step of providing a plunger varying from the length of the plunger of said reference injector by no more than the amount 0.25r.

4. A method as in claim 1, said step of providing a modified plunger including the step of providing a plunger of the same length as the plunger of said reference injector.

* * * * *

UNITED STATES PATENT AND TRADEMARK OFFICE

CERTIFICATE OF CORRECTION

PATENT NO. : 6,321,723 B1 
DATED : November 27, 2001
INVENTOR(S) : Albert J. Merkle and Rodney Bormann It is certified that error appears in the above-identified patent and that said Letters Patent is hereby corrected as shown below:

Title page,
Item [56], References Cited, U.S. PATENT DOCUMENTS, please insert the following:

| | | | |
|---|---|---|---|
| -- | 3,566,849 | 7/1969 | Frick |
| | 4,826,081 | 5/1989 | Zwick |
| | 5,467,924 | 11/1995 | Buescher et al. |
| | 5,494,015 | 2/1996 | Rynhart |
| | 5,870,996 | 2/1996 | DeLuca |
| | 5,980,224 | 11/1999 | Regueiro |
| | 6,009,850 | 1/2000 | DeLuca |
| | 6,012,433 | 1/2000 | Buescher -- |

Column 4,
Line 35, please delete “distance t” and insert therefor -- distance t --.
Line 38, please delete “helix 48” and insert therefor -- helix 46 --.

Signed and Sealed this

Third Day of June, 2003

JAMES E. ROGAN
*Director of the United States Patent and Trademark Office*